US011826778B2

(12) United States Patent
Bicker et al.

(10) Patent No.: US 11,826,778 B2
(45) Date of Patent: Nov. 28, 2023

(54) PHARMACEUTICAL PACKAGING WITH LUBRICATING FILM AND METHOD FOR PRODUCING SAME

(71) Applicant: Schott AG, Mainz (DE)

(72) Inventors: Matthias Bicker, Mainz (DE); Hartmut Bauch, Ober-Olm (DE); Manfred Lohmeyer, Nackenheim (DE)

(73) Assignee: SCHOTT AG, Mainz (DE)

( * ) Notice: Subject to any disclaimer, the term of this patent is extended or adjusted under 35 U.S.C. 154(b) by 281 days.

(21) Appl. No.: 16/103,762

(22) Filed: Aug. 14, 2018

(65) Prior Publication Data

US 2018/0353994 A1 Dec. 13, 2018

Related U.S. Application Data

(62) Division of application No. 13/395,602, filed as application No. PCT/EP2010/005618 on Sep. 14, 2010, now Pat. No. 10,071,397.

(30) Foreign Application Priority Data

Sep. 14, 2009 (DE) ..... 10 2009 041 132.1

(51) Int. Cl.

| | |
|---|---|
| ***B05D 5/08*** | (2006.01) |
| ***B05D 3/14*** | (2006.01) |
| ***B05D 7/22*** | (2006.01) |
| *B05D 1/00* | (2006.01) |
| *B05D 3/04* | (2006.01) |

(52) U.S. Cl.

CPC ..... *B05D 5/083* (2013.01); *B05D 3/141* (2013.01); *B05D 7/22* (2013.01); *B05D 1/62* (2013.01); *B05D 3/0493* (2013.01); *B05D 3/147* (2013.01); *B05D 2201/02* (2013.01); *B05D 2203/35* (2013.01)

(58) Field of Classification Search

CPC ..... B05D 5/083; B05D 3/141; B05D 7/22; B05D 1/62; B05D 3/0493; B05D 3/147; B05D 2201/02; B05D 2203/35

See application file for complete search history.

(56) References Cited

U.S. PATENT DOCUMENTS

| | | | |
|---|---|---|---|
| 4,767,414 | A | 8/1988 | Williams et al. |
| 4,822,632 | A | 4/1989 | Williams et al. |
| 5,444,540 | A | 8/1995 | Dragotta |
| 5,456,940 | A | 10/1995 | Funderburk |

(Continued)

FOREIGN PATENT DOCUMENTS

| | | |
|---|---|---|
| DE | 4242633 C2 | 11/1996 |
| DE | 10224395 | 12/2003 |

(Continued)

OTHER PUBLICATIONS

Garrison et al. "Glow discharge plasma deposited hexafluoropropylene films: surface chemistry and interfacial materials properties" Thin Solid Films 352 (1999) 13-21.*

(Continued)

*Primary Examiner* — Robert S Walters, Jr.
(74) *Attorney, Agent, or Firm* — Ruggiero McAllister & McMahon LLC

(57) ABSTRACT

A pharmaceutical packaging including a silicone-free lubricating film of crosslinked organic molecules, and a method for producing same.

18 Claims, 4 Drawing Sheets

(56) References Cited

U.S. PATENT DOCUMENTS

| | | | | |
|---|---|---|---|---|
| 5,775,506 | A | 7/1998 | Grabenkort | |
| 7,428,807 | B2 | 9/2008 | Vander Bush | |
| 7,431,989 | B2 * | 10/2008 | Sakhrani | B29C 59/14 428/411.1 |
| 2004/0050960 | A1 | 3/2004 | Godfrey et al. | |
| 2004/0144733 | A1 | 7/2004 | Cooper et al. | |
| 2004/0231926 | A1 | 11/2004 | Sakhrani et al. | |
| 2007/0187280 | A1 | 8/2007 | Haines et al. | |
| 2008/0071228 | A1 | 3/2008 | Wu et al. | |
| 2009/0010985 | A1 | 1/2009 | Sakhrani et al. | |
| 2009/0304549 | A1 | 12/2009 | Coulson | |
| 2010/0298738 | A1 | 11/2010 | Felts | |
| 2011/0313363 | A1 | 12/2011 | D'Souza | |
| 2012/0171386 | A1 | 7/2012 | Bicker | |

FOREIGN PATENT DOCUMENTS

| | | | |
|---|---|---|---|
| DE | 10314067 | | 10/2004 |
| DE | 102005040266 | A1 | 3/2007 |
| DE | 102009041132 | | 4/2011 |
| EP | 0201915 | | 1/1990 |
| EP | 0201915 | B1 | 1/1990 |
| EP | 1860140 | A1 | 11/2007 |
| EP | 2147988 | | 1/2010 |
| GB | 2107923 | A | 5/1983 |
| WO | 94/14183 | A1 | 6/1994 |
| WO | 2008/053150 | A1 | 5/2008 |
| WO | 2011029628 | | 3/2011 |

OTHER PUBLICATIONS

MatWeb Material Property Data for Fomblin M100 accessed at https://www.matweb.com/search/DataSheet.aspx?MatGUID=0dd62fee08174f73ab7c1d5091ef30c5 on Oct. 13, 2022.*

International Search Report dated Jul. 5, 2012 corresponding to International Patent Application No. PCT/EP2012/000162, 3 pages.

International Preliminary Report on Patentability dated Jul. 25, 2013 corresponding to PCT/EP2012/000162, 9 pp.

Riederer, Florian, "PCT Application No. PCT/EP2010/005618 International Search Report dated Jan. 4, 2011", Publisher: PCT, Published in: PCT.

Riederer, Florian, "PCT Application No. PCT/EP2010/005618 International Preliminary Report on Patentability dated Jan. 13, 2012",, Publisher: PCT, Published in: PCT.

Riederer, Florian, "PCT Application No. PCT/EP2010/005618 International Preliminary Examination Report dated Nov. 23, 2011",, Publisher: PCT, Published in: PCT.

Notice of Allowance received for U.S. Appl. No. 13/395,602, dated May 7, 2018, 10 pages.

Non-Final Office Action received for U.S. Appl. No. 13/395,602, dated Mar. 15, 2017, 15 pages.

Non-Final Office Action received for U.S. Appl. No. 13/395,602, dated Mar. 4, 2014, 11 pages.

Non-Final Office Action received for U.S. Appl. No. 13/395,602, dated Jun. 23, 2015, 14 pages.

Non-Final Office Action received from U.S. Appl. No. 13/395,602, dated Jul. 12, 2016, 16 pages.

Final Office Action received for U.S. Appl. No. 13/395,602, dated Oct. 26, 2016, 15 pages.

Final Office Action received for U.S. Appl. No. 13/395,602, dated Oct. 8, 2015, 18 pages.

Final Office Action received for U.S. Appl. No. 13/395,602, dated Nov. 16, 2017, 5 pages.

Final Office Action received for U.S. Appl. No. 13/395,602, dated Jul. 10, 2014, 9 pages.

Examiner initiated interview summary received for U.S. Appl. No. 13/395,602, dated May 7, 2018, 1 pages.

Advisory Action received for U.S. Appl. No. 13/395,602, dated Feb. 5, 2018, 3 pages.

Advisory Action received for U.S. Appl. No. 13/395,602, dated Dec. 18, 2015, 4 pages.

Surface tension prediction of vegetable oils using artificial neural networks and multiple linear regression, Melo-Espinosa et al., Energy Procedia 57 ( 2014 ) 886-895.

Ionic Liquids as Grease Base Liquids, Mozes et al., Lubricants, Aug. 2017.

* cited by examiner

PHARMACEUTICAL PACKAGING WITH LUBRICATING FILM AND METHOD FOR PRODUCING SAME

RELATED APPLICATIONS

This application is a divisional of co-pending U.S. application Ser. No. 13/395,602, filed Mar. 12, 2012, which a 371 U.S. National Stage of International PCT Application No. PCT/EP2010/005618 filed Sep. 14, 2010, which claims priority to German Application No. 10 2009 041 132.1 filed Sep. 14, 2009, the entire disclosures of which are incorporated herein by reference.

BACKGROUND OF THE INVENTION

From prior art, silicone oil-based lubricating films are known that have found use in diverse industries. Especially for parenteral pharmaceutical packaging, such as syringes and carpules, silicone oils are commonly used as lubricating film systems. For example, U.S. Pat. No. 4,767,414 A describes a method for reducing static and dynamic friction between sliding surfaces by applying a lubricating film to at least one of the surfaces. A low molecular weight silicone oil is applied to one of the surfaces. The silicone oil and the surface are treated by a plasma.

However, some biopharmaceutical products are intolerant to silicone oil, so that they do not exhibit sufficient stability in conventional siliconized packaging such as prefilled siliconized syringes. A known cause for this silicone oil intolerance is that silicone oil tends to form particles, thereby triggering a silicone oil-particle-induced protein aggregation.

Therefore, the market side is currently looking for new packaging solutions that enable to stably store biopharmaceuticals in a silicone-free, prefilled syringe system ("PFS=prefillable syringe"). This requires a new lubricating film system which meets the requirements on tribological properties for the friction partners syringe barrel/stopper, and at the same time exhibits only low surface interaction with the biomolecules of the drug formulation.

US 2004/0231926 A1 describes a method for producing a lubricating film, wherein the lubricating film is cured at atmospheric pressure, using among other things an atmospheric pressure plasma. Besides silicone oil-based coatings, perfluoropolyether-based lubricating films can be produced. However, the breakaway force or static friction of the latter films has proved to be higher than that of cured silicone oil films. Moreover, during an atmospheric pressure treatment, in particular in an atmospheric pressure plasma treatment, increased incorporation of gases, especially of reaction products of the plasma, into the film may occur.

SUMMARY OF THE INVENTION

An object of the invention is to provide improved lubricating films compared to the prior art, and in particular films for pharmaceutical packaging, and to implement an improved manufacturing method for silicone-free lubricating films which is particularly well suited for mass production in an industrial manufacturing process, especially in view of the requirements on a production of pharmaceutical packaging, and which is efficient. This object is solved by the subject matter of the independent claims. Advantageous embodiments and refinements are set forth in the respective dependent claims.

The invention proposes a silicone-free lubricating film with tailored surface properties, and a method for producing this lubricating film system. The silicone-free lubricating film exhibits a low surface energy that is precisely adjustable through the method, and correspondingly a precisely adjustable wetting behavior for a wide range of liquids having different levels of polar and disperse surface tensions. The inventive method allows to achieve a good film homogeneity with a uniform film thickness distribution, a uniform surface energy, and a correspondingly uniform wetting behavior.

It was shown that such desired film properties can be achieved by a two-step manufacturing process, wherein in a first process step, a silicone-free fluid is applied onto the inner surface of the substrate and, in a second process step, is crosslinked using a low-pressure glow discharge.

A specific feature of the present invention is that this low-pressure glow discharge provides for a very homogeneous surface treatment whereby the silicone-free fluid is crosslinked very homogeneously, and enables to set very uniform surface properties. Low-pressure glow discharge proves to be advantageous, since due to the low process pressure the energy input of the particles to the silicone-free fluid is higher which results in a better crosslinking and selective surface functionalization which is associated with a precisely set surface energy.

In this method, the fluid is uniformly applied to the substrate, stabilized by the low-pressure glow discharge through crosslinking, and homogenized at the surface, which allows in very simple manner to produce a silicone-free, or generally silicon-free lubricating film system with a very uniform film thickness distribution.

A most surprising finding from studies of the influence of surface treatment on the surface properties of the silicone-free lubricating film is that the surface energy of the film is significantly reduced only by the low-pressure glow discharge treatment.

Against all expectations, a film that has only been spray-deposited but is otherwise untreated, has a relatively high surface energy, whereas solely by a treatment using the low-pressure glow discharge, the surface energy is substantially reduced. Thus, according to the invention this method of treatment has the advantage that an extremely low surface energy is provided for the film system at the sliding surface, whereby the adhesion energy and the associated breakaway forces between the friction partners are substantially reduced in a very simple way.

Another advantage of the invention is that the lubricating film surfaces produced by this surface treatment exhibit a repulsive wetting behavior for a whole spectrum of liquids each having different levels of polar and disperse components of the surface tension which is expressed by high contact angles. Accordingly, by virtue of the inventive low-pressure plasma treatment both the polar and the disperse fraction of the surface energy can be reduced simultaneously, which is associated with a liquid-repellent wetting behavior for liquids having different polar and disperse fractions of the surface energy.

Another advantage of the process of low-pressure glow discharge is that with this process a surface pre-treatment can be performed which enables to remove especially organic residues from the substrate surface. When coating pharmaceutical syringe barrels, for example in the form of prefillable syringes, a particular technical challenge is the purification of the narrow Luer channel of the syringe barrel. It was shown that the low-pressure glow discharge on the one hand burns very evenly in the cylinder region of the syringe, and the other hand even ignites into the Luer channel and there continues to burn evenly. Thus, according to the invention this very simple method allows in a surprising way to cure the silicone-free lubricating film in the syringe cylinder and simultaneously to remove any organic residues on the inner surface of the Luer channel. By removing the organic residues, contamination of the product (e.g. a drug solution), and surface interaction of the organic compounds with the product can be avoided.

The invention will now be described in more detail with reference to the accompanying figures. In the figures, the same reference numerals designate the same or equivalent elements.

DETAILED DESCRIPTION

Figure 1A:
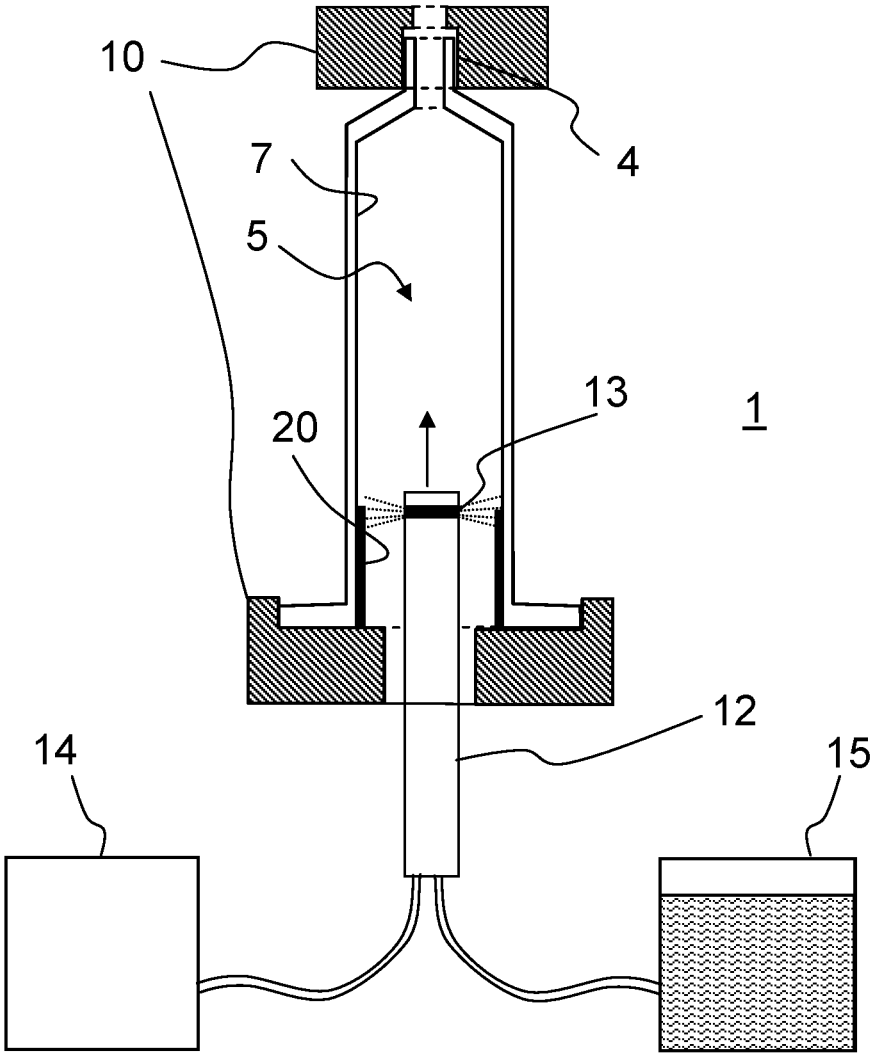
FIGS. 1A and 1B show method steps for producing a lubricating film.

The invention relates to a method for producing a lubricating film on a surface, wherein on a surface of a hollow substrate for the lubricating film, in particular of a pharmaceutical packaging

- a silicone-free organic fluid is applied as a film;
- the substrate is placed in a vacuum reactor; and
- the vacuum reactor is evacuated; and wherein an alternating electromagnetic field is generated by an AC voltage source and is introduced into the interior of the substrate, the field strength in the gas which is present in or introduced into the evacuated cavity of the substrate being sufficient to cause a homogeneous glow discharge under the pressure prevailing in the cavity of the substrate; wherein
- the pressure of the gas is set to less than 100 millibars, and wherein the lubricating film is subjected to the gas particles ionized during glow discharge and accelerated in the alternating electromagnetic field and to the electrons generated during ionization, and wherein the gas particles by virtue of their energy input break the molecules of the film which as a result thereof crosslink with each other, so that a crosslinked lubricating film is produced, wherein with crosslinking the surface energy of the lubricating film is modified, in particular reduced.

Especially, by means of the AC voltage source a pulsed low-pressure glow discharge can be generated, wherein the lubricating film is exposed to the gas particles ionized in the pulsed glow discharge and accelerated in the alternating electromagnetic field, and to the electrons produced during ionization.

Typically, glow discharges are produced between two electrically conductive electrodes. It is surprising here that it is possible to produce a low-pressure glow discharge by means of a continuously operating AC voltage source when introducing a dielectric barrier material, in particular the substrate material itself. In other words, according to the invention, surprisingly, a low-pressure glow discharge is not only ignited and stabilized in the presence of an electrically insulating organic fluid, but is even maintained with a spatially very homogeneous discharge.

The invention or the inventive lubricating films or the pharmaceutical packagings provided with the lubricating films according to the invention are particularly suitable to be used for storage of protein-containing drugs or protein-containing drug formulations.

The pressure set in the cavity of the substrate during plasma treatment is preferably in a range from 0.05 to 100 mbars, more preferably in a range from 0.2-20 mbars, most preferably in a range from 0.5-10 mbars.

The method described above allows to produce a medical packaging which has a cavity for receiving a pharmaceutical drug, wherein the cavity is provided with a silicone-free organic lubricating film, and wherein the lubricating film includes crosslinked organic molecules, in particular is formed of crosslinked organic molecules, and has a surface energy of not more than 60 mN/m.

In particular, the invention enables to produce even significantly lower surface energies of the silicone-free lubricating film. So, by adequately modifying the lubricating film within the plasma, surface energies of less than or equal to 40 mN/m, preferably less than or equal to 30 mN/m, even less than or equal to 25 mN/m can be produced.

It has been shown that the reduction of surface energy depends on the average power per unit mass flow which is introduced into the plasma by the alternating electromagnetic field.

In particular, by the treatment method with low-pressure glow discharge, the surface energy of the silicone-free lubricating film can be reduced in comparison to the untreated lubricating film surface by at least 3 mN/m, generally even by at least 5 mN/m. Maximum levels of reduction of the surface energy are by 40 mN/m, preferably by 38 mN/m.

Also surprisingly, not only an overall reduction in surface energy can be observed, but rather generally both the polar and the disperse fractions of the surface energy is lowered. This result was found upon investigation of the polar and disperse components by the Owens-Wendt-Rabel-Kaelble method.

So in a refinement of the invention the polar component of the surface energy of the silicone-free lubricating film is less than 50 mN/m, preferably less than or equal to 20 mN/m, more preferably less than or equal to 16 mN/m. The disperse component of the surface energy of the silicone-free lubricating film is less than 40 mN/m, preferably less than or equal to 20 mN/m, more preferably not more than 10 mN/m. The low polar surface energy results in the large contact angles for polar substances such as water as mentioned above.

Since the disperse component of the surface energy is also low or is reduced by the inventive treatment of the lubricating film, also less polar substances typically exhibit large contact angles. Thus, a contact angle for diiodomethane can be achieved in a range from 40° to 140°, preferably in a range from 80° to 120°, more preferably in a range from 95° to 115°.

Furthermore, by virtue of the invention, the following contact angles can be achieved:

For ethylene glycol, contact angles in a range from 20° to 100°, preferably in a range from 35° to 110°, more preferably in a range from 60° to 105°.

For thiodiethanol, contact angles in a range from 20° to 120°, preferably in a range from 35° to 110°, more preferably in a range from 60° to 105°.

In this way, very advantageous surface properties are obtained, since the surface in these cases is only poorly or moderately wetted by both polar and non-polar substances.

The lubricant may serve to ensure improved emptying, for example in an ampule or a pharmaceutical vial. For example, the invention can be used very beneficially for coating the inner surface of containers for storage of lyophilisates and other pharmaceutical drugs. In particular, the invention is suitable to reduce friction between two surfaces sliding on one another. Here, the most important example are cylinder and plunger surfaces such as that of syringes and carpules. Accordingly, in a preferred embodiment of the invention the coated cavity of the pharmaceutical packaging comprises a cylinder for guiding a plunger.

Thus, the method according to the invention allows to provide pharmaceutical packagings which include two elements that slide on one another, such as especially the plunger and barrel of a syringe or carpule, wherein one of the sliding surface is provided with a lubricating film according to the invention, wherein the dynamic sliding friction force measured at an advance speed of 100 millimeters per minutes is less than 20 N, preferably less than 13 N, more preferably less than 5 N, and/or wherein the breakaway force is less than 30 N, preferably less than 20 N, more preferably less than 12 N.

In particular, the silicon-free films manufactured using low-pressure glow discharge exhibit excellent storage stability in the application test, which is achieved by a very good crosslinking in the film due to a high energy input during the low-pressure glow discharge treatment: After storing the packaging with distilled water or "water for injection" ("WFI") at 40° C. for a period of more than 100 days, the dynamic sliding friction force measured at an advance speed of 100 millimeters per minute is still below 20 N, and the breakaway force is less than 30 N.

The repellent wetting behavior described above has found to be particularly favorable for applications of silicone-free lubricating films in parenteral, prefilled syringe systems, because in this way it can be achieved that a liquid drug formulation which is filled into the prefillable syringe runs well on the inner sliding surface of the prefilled syringe and therefore, upon injection, can be removed from the syringe system very well and with a high yield.

Often, one of the elements sliding on one another is made of an elastomer, to obtain a good seal. Especially the plunger of a syringe or carpule or the sliding surface thereof is often made of an elastomer. However, just elastomers often exhibit higher friction levels and breakaway forces. It has been shown in this context, that the invention is particularly useful to reduce the breakaway force and sliding friction, especially for surfaces sliding on one another one of which is an elastomer. For a medical packaging having two elements that slide on one another, namely a syringe or carpule cylinder and an elastomer, with both sliding surfaces of the elements provided with a fluoro-organic lubricating film according to the invention, it could be verified that the dynamic sliding friction force measured at an advance speed of 100 millimeters per minute is less than 10 N, and that the breakaway force is less than 20 N.

Generally, perfluorinated lubricating films are particularly suitable, not only limited to medical packaging with elastomeric elements. It could be shown for such films on a medical packaging that has two elements which slide on one another, namely a syringe or carpule cylinder and an elastomer, with both sliding surfaces of the elements provided with a fluoro-organic lubricating film according to the invention, that the dynamic friction force measured at an advance speed of 100 millimeters per minute is less than 10 N, and that the breakaway force is less than 20 N.

Accordingly, a particularly preferred embodiment of a medical packaging according to the invention has two elements that slide on one another, especially in form of a syringe or carpule cylinder and an elastomer, in particular on a plunger as one of the elements sliding on each other, wherein both sliding surfaces of the elements and also the substantial or entire surface portion of the contact surfaces of the elements to the product or to the cavity enclosed by the packaging is coated with a perfluorinated lubricating film. Optionally, in a syringe barrel a coating of the Luer cone can be dispensed with. The major surface portion will still be provided with a lubricating film according to the invention.

So in this case not only an improved sliding behavior of a syringe plunger is achieved, but at the same time improved emptying of the syringes.

Additionally, the silicone-free lubricating films according to the invention are characterized by the fact that the film includes less or no decomposition or reaction products. Decomposition or reaction products formed during crosslinking at atmospheric pressure, are especially ozone and nitrogen oxides.

In addition to liquid drug formulations, a silicone-free lubricating film system according to the invention can also be employed in storage containers for lyophilisates, since the properties of the film and the surface thereof have a positive impact on the reconstitution of the lyophilisate. Also, protein-based drug formulation solutions can be stored very beneficially with only little interaction with the lubricating film. Especially with silicone-containing lubricating films, the aforementioned drugs may entail reactions such as flocculation.

Another embodiment of the invention provides for simultaneous sterilization or pre-sterilization of the medical article. Here, the method according to the invention offers advantages because due to the higher energy input of the species in the low-pressure discharge a particularly good sterilization effect is achieved when compared to an atmospheric pressure plasma which is accompanied by a smaller energy input.

The low surface energy produced by the low-pressure glow discharge is associated with a correspondingly large contact for water, which is at least 60°. Typically, a contact angle for water on the silicone-free lubricating film is obtained in a range from 60° to 140°. Especially with fluorinated organic molecules as constituents of the lubricating film, actually, contact angles for water can be achieved in a range from 65° to 130°, even in a range from 70° to 125°.

For applying a lubricating film of uniform thickness, spray coating has proven particularly suitable. Since typical suitable silicone-free lubricants, such as fluorinated polyethers, generally have a high viscosity, an application by means of a dual-material nozzle is especially suitable. Such an application process co-operates with the very uniform crosslinking by the low pressure plasma according to the invention, since spray coating allows to apply very uniform films on the inner wall of the substrate which, through the low-pressure glow discharge, are very evenly crosslinked and modified at the surface, so that all in all very uniform surfaces can be achieved.

Single-material atomizers may also be used. To obtain droplets of a small size, ultrasonic atomizers may especially be used as the single-material atomizers. In case of a dual-material atomizer, ultrasound may likewise be used beneficially to help in breaking the surface tension to form fine droplets.

Besides spray coating, other application methods are possible. So, according to another embodiment of the invention, the lubricating film is applied onto the wall of the cavity using a process that uniformly wets the substrate surface within the treatment zone, preferably in form of a mandrel withdrawal process, wipe process, or flow process.

In this way, levels of uniformity of the film thickness, U=Dmin/Dmax, within the syringe barrel can be achieved for the region in which the stopper is moved, with values of U≥0.1; preferably U≥0.2; in particular U≥0.3. In a special embodiment, there is a particularly high uniformity U of film thicknesses of the silicone-free lubricating film, with U≥0.5, or even U≥0.7.

Fluids of higher viscosity having a correspondingly higher molecular weight are preferred to facilitate crosslinking of the molecules. Preferably, the lubricating film is produced of a material having a viscosity index (according to the ASTM D 2270 standard) of more than 80, preferably more than 100, most preferably more than 150.

Particularly suitable for the invention are organic fluids with fluoroalkyl and/or ethylene groups as set forth below. Fluids with fluorinated or perfluorinated polyethers are particularly useful.

In particular, silicon-free organic fluids have proven to be suitable which include molecules with the following molecular structure:

(i) R1-(O—CF—R—$CF_2$)$_p$—(O—$CF_2$)$_q$—R2; with p/q in a range from 0.1 to 1.0, and with R=—$CF_3$, or R=—F, (ii) functional groups R1, R2 selected from the group of: —$CF_3$, —F, —OH, —$C_xH_y$—OH, —$CH_2$—OH, —$CH_2(OCH_2CH_2)_r$OH, —$CH_2OCH_2CH$ (OH) $CH_2OH$, —$CH_2OCH_2$-piperonyl.

$CF_2$ and $CF_3$ groups are proving to be beneficial to reduce the surface energy and thus to minimize the surface and adhesion energy between the friction partners which results in a low static friction. Furthermore, these groups provide good lubricating properties, by the crosslinked interfacial film.

For igniting the glow discharge after application of the lubricating film and evacuation of the cavity of the substrate, according to one embodiment of the invention, an electrode is arranged in the cavity of the substrate, and an alternating electromagnetic field is generated by means of an AC voltage that is applied between the electrode in the cavity of the substrate and an outer electrode.

Especially for small-volume pharmaceutical packagings, it is moreover favorable to concurrently use the electrode inside the cavity for supplying process gas or for evacuating the cavity. To this end, a passage for supply of gas or discharge of gas may be provided in the electrode. In a particularly preferred embodiment of the invention, a hollow electrode is used through which the process gas is sucked off via a vacuum channel.

According to another embodiment of the invention, the alternating electromagnetic field may be radiated into the cavity from the outside. Suitable for this purpose are higher frequencies, for example in the microwave range, such as a frequency of 2.45 GHz.

Figure 1B:
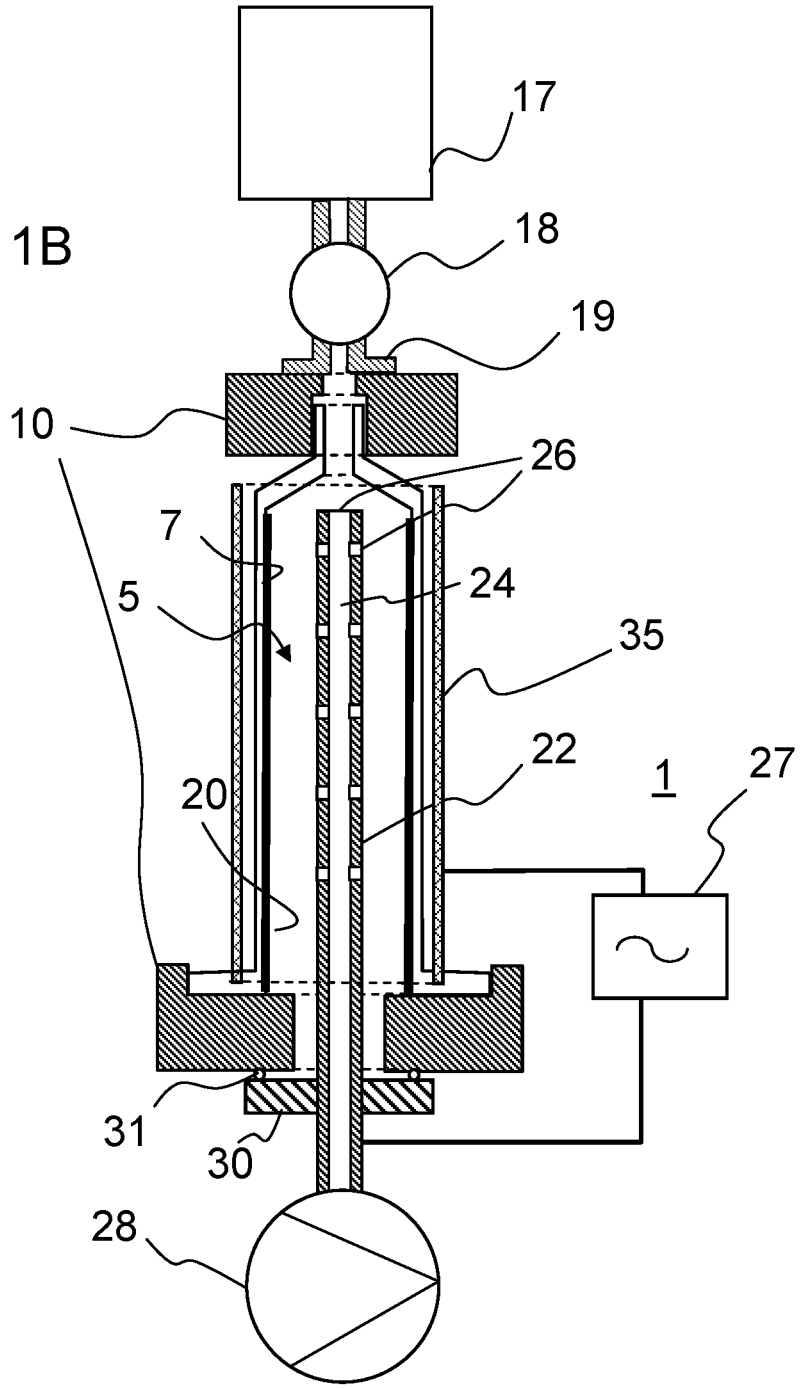

One embodiment of the invention is illustrated in FIGS. 1A and 1B. First, a substrate having a cavity is arranged in a bracket 10 of a coating apparatus 1 for carrying out the method. In the illustrated embodiment, the substrate is a pharmaceutical packaging, especially a syringe 3 having a cavity 5. Both glass and plastic material is suitable as a substrate material for a well adhering lubricating film. A preferred glass is borosilicate glass. Plastics that can be used are cyclo-olefin polymers, or cyclo-olefin copolymers, without being limited thereto. Elastomers are also suitable. These include, inter alia, elastomeric components with styrene-butadiene copolymer, acrylonitrile-butadiene copolymer, chloroprene, polysulfide elastomer, urethane elastomer, stereo rubber, ethylene-propylene elastomer, butyl rubber, including halobutyl elastomer such as e.g. bromobutyl elastomer, chlorobutyl elastomer, polyisporene bromobutyl elastomer, TPX or laminates thereof, especially laminates which include ETFE, PTFE polymers.

Cavity 5 forms the barrel of syringe 3 and therefore serves to accommodate a syringe plunger, which slides on the inner wall 7 of cavity 5 in an axial movement. A nozzle lance 12 including a dual-material nozzle 13 with an atomizer with annular gap is inserted into the cavity, the lance being connected to a pressurized gas source 14 and a reservoir 15 that includes the organic silicon-free fluid. While moving the lance in axial direction, as indicated by the arrow, the lubricant film 20 is applied to the inner wall 7. To this end, the compressed gas is blown into dual-material nozzle 13 thereby entraining particles of the organic silicon-free fluid and atomizing them. Of course, the movement of the nozzle lance in axial direction from the plunger opening towards the top section for the cannula is not mandatory. Application of the lubricating film 20 under a movement in the opposite direction is also possible.

For producing silicone-free lubricating films with very good sliding properties, it has proved to be particularly favorable to apply a quantity of fluid to the inner surface of the hollow body ranging from 0.004 μl/cm$^2$ to 2.8 μl/cm$^2$, preferably ranging from 0.009 μl/cm$^2$ to 0.22 μl/cm$^2$. It has been shown that after crosslinking of this surface-related quantity of fluid using a low pressure glow discharge, silicon-free lubricating films with very high storage stability can be produced.

For spray coating, the following preferred parameters proved to be favorable to achieve lubricating films of uniform thickness:

a) a spray rate ranging from 0.01 μl/s-100 μl/s, preferably ranging from 0.05 μl/s to 20 μl/s;

b) a spray pressure in a range from 0.1-5 bars, preferably in a range from 0.2 to 2.5 bars, more preferably in a range from 0.3 to 2.5 bars;

c) a fluid quantity in a range from 0.004 μl/cm$^2$ to 2.8 μl/cm$^2$, preferably in a range from 0.009 μl/cm$^2$ to 0.22 μl/cm$^2$ is sprayed onto the inner surface of the hollow body;

d) the dual-material nozzle is moved during the spraying operation with an advance speed from 1 mm/s to 1000 mm/s, preferably in a range from 5 mm/s to 200 mm/s, more preferably in a range from 8 mm/s to 50 mm/s.

Without being limited to the example shown in FIG. 1A, the lubricating film is preferably applied in a thickness ranging from 50 nm to 50 μm, in particular in a range from 100 nm to 10 μm, more preferably in a range from 150 nm to 8 μm. These film thicknesses are favorable, both to avoid too much pressure on the sliding surfaces given the predefined dimensions of the pharmaceutical packaging elements sliding on one another on the one hand, and to avoid shearing off the lubricating film material during the sliding motion on the other hand. Furthermore, the film thicknesses mentioned above are favorable to achieve a sufficient lubrication effect and to ensure tightness of the syringe system both for the product and against microbes.

Subsequently, according to the exemplary embodiment shown in FIG. 1B, a container 17 including a process gas is connected, via a metering valve 18, to bracket 10 holding syringe 3 that is coated at its inner surface. The connecting piece 19 for supplying process gas may, other than shown in FIG. 1B, be connected directly with the substrate to be coated. To this end, connecting piece 19 may be made of a flexible material so that it can be sealingly fitted around the extension 4 intended for placing the cannula.

Preferably, inert gases such as helium, neon, argon, or xenon are used as process gases. Nitrogen, oxygen, hydrogen, carbon dioxide, or mixtures of these gases may be used likewise. An electrode 22 is inserted through the plunger opening of the syringe, so that it extends in axial direction along lubricating film 20 on the inner wall 7 of syringe 3. Thereby, the opening in bracket 10 through which electrode 22 is inserted is closed in vacuum-tight manner. In the example shown in FIG. 1B, a base plate 30 is used for this purpose which is connected to the electrode and engages bracket 10, with a seal 31 sandwiched therebetween.

The electrode has at least one or a plurality of openings 26 connected to an axial passage 24. Passage 24 is connected to a vacuum pump 28. By means of vacuum pump 28, cavity 5 of syringe 3 is evacuated trough passage 24 and openings 26. The process gas is introduced into cavity 5 via the control valve. Control valve 18 is adjusted such that the pressure in the cavity is less than 100 millibars. The control valve can be provided in form of a mass flow controller which regulates the mass flow. Also, in an alternative embodiment the process pressure can be regulated by a throttle valve on the vacuum side. The arrangement shown in FIG. 1B with an axially symmetric supply of process gas and an axisymmetrically arranged passage 24 for evacuation of cavity 5 achieves an axisymmetric volume flux of process gas which generally proved to be advantageous for homogeneous crosslinking in film 20, without being limited to the exemplary embodiment.

Mass flows of the process gas or process gas mixture that have proven advantageous for crosslinking in the film, for forming a homogeneous plasma zone in the region of the cavity and a related homogeneous reduction in surface energy, are in a range from 1 sccm to 800 sccm, preferably from 2 sccm to 500 sccm, more preferably from 5 sccm to 250 sccm.

By means of an AC voltage source 27, an alternating voltage is applied between electrode 22 and a further electrode 35 enclosing syringe 3, e.g. a cylindrical electrode. The field strength of the AC voltage is selected such that, by taking into account the pressure in the cavity and the ionization potential of the process gas, a glow discharge is produced. A homogeneous low-pressure glow discharge is particularly preferred.

For excitation of the low-pressure glow discharge, without limitation to the specific embodiment of FIG. 1B, a medium frequency source with a frequency below 120 kHz, preferably in a range from 40-110 kHz, more preferably in a range from 60-100 kHz, most preferably from 60 to 90 kHz has proven to be particularly suitable.

Furthermore, it proved advantageous to use a pulsed low-pressure glow discharge. The pulsed low-pressure glow discharge can be produced, for example, by operating AC voltage source 27 in a pulsed mode. Accordingly, in a refinement of the invention a pulsed low-pressure glow discharge is generally proposed for crosslinking the molecules in the lubricating film.

Figure 2:
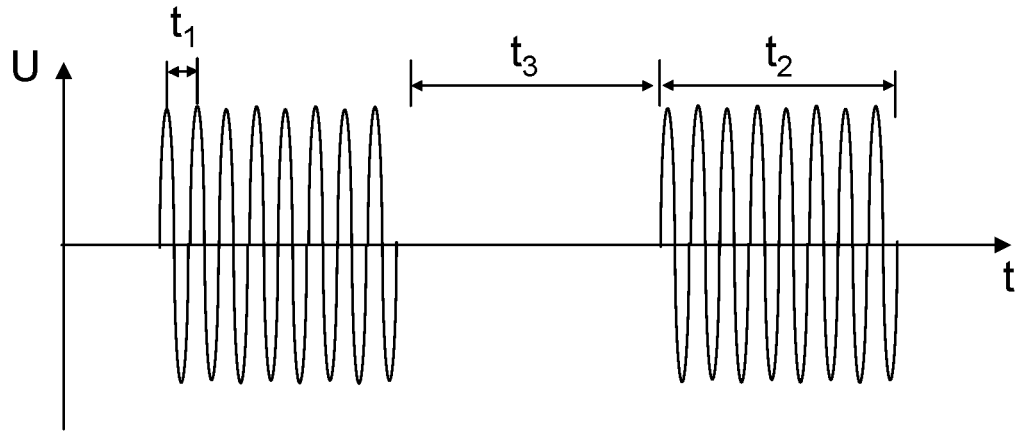
FIG. 2 shows a voltage-time characteristic of an AC voltage source for the low-pressure glow discharge.

FIG. 2 shows a pulse sequence of an AC voltage source operated in this way. In the diagram shown in FIG. 2, voltage U is plotted versus time t. The AC voltage with a period of $t_1$ is divided into pulses of a length $t_2$, with pulse pauses of a length $t_3$ between the pulses. With a medium frequency of 90 kHz, period $t_1$ is approximately 11 microseconds. Periods $t_2$ and $t_3$ may each be longer than period $t_1$, for example, by at least a factor of 10. Furthermore, it was found to be advantageous for the pulse pauses to be longer than the pulse lengths, i.e. if $t_2<t_3$. Namely, it turned out that the pulsed curing process with a low-pressure glow discharge is highly efficient and that, during the pulse pause, decomposition products from the plasma process can be removed without significantly delaying the entire manufacturing process. A duty cycle with $t_2 \leq 0.4 \cdot t_3$ has shown to be very favorable, most favorable with $t_2 \leq 0.1 \cdot t_3$. In another embodiment of the invention, the AC voltage source is operated continuously, and a pulsed low-pressure glow discharge is produced while introducing a dielectric barrier material, in particular the material of the pharmaceutical packaging itself, or the wall thereof. In the context of this further embodiment, an energy source may be used for producing the pulsed low-pressure glow discharge which is continuously operated in a medium to high frequency range between 1 kHz and 100 MHz.

Regardless of whether a pulsed or continuous glow discharge is employed, the treatment duration for effective crosslinking of the lubricating film can generally be limited to less than 5 seconds, preferably even less than 3 seconds.

A specific advantage of the invention is that crosslinking can be produced very evenly on the surface. In this way local variations of the surface energy are reduced. In particular, coated pharmaceutical packagings according to one embodiment of the invention are characterized by the fact that the surface energy of the lubricating film within the coated region varies by less than ±20 mN/m from the mean, preferably by less than ±10 mN/m. Accordingly, the contact angle for water on the lubricating film then varies by less than ±25° from the mean, preferably by less than ±15°.

To achieve such uniform crosslinking, it is particularly advantageous for the glow discharge to be free of local discharges, such as streamers or filaments.

To this end, according to an advantageous modification of the invention it is proposed to adjust the pressure in the cavity and the field strength of the electromagnetic alternating field such that an abnormal glow discharge is produced in the cavity of the substrate which exhibits a current/voltage characteristic with positive slope.

Figure 3:
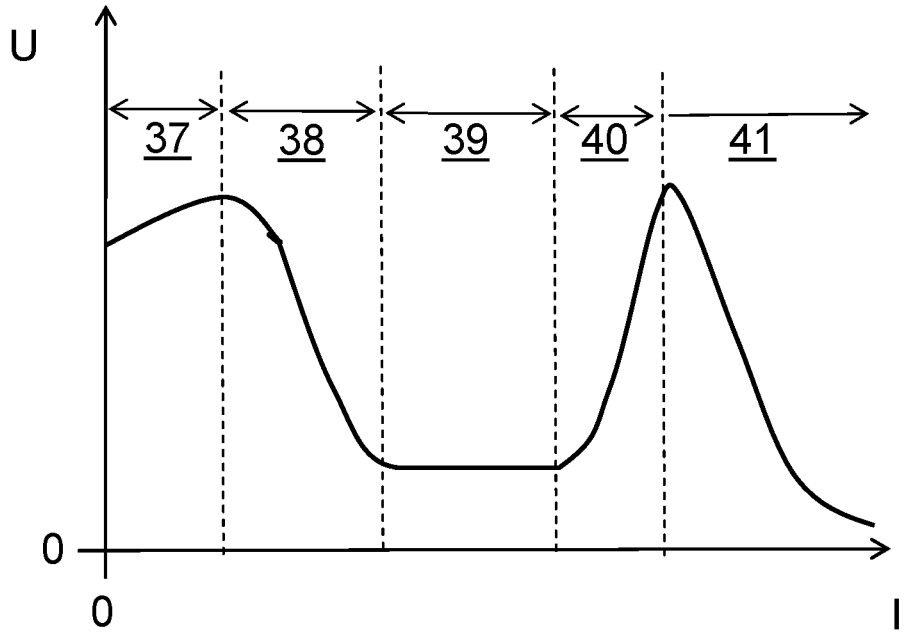
FIG. 3 shows a current-voltage characteristic of a glow discharge.

For illustration purposes, FIG. 3 schematically shows a current-voltage characteristic of a glow discharge.

The current-voltage characteristic of a glow discharge in which the voltage applied to the electrodes is plotted versus the current transferred by the discharge, may be divided into the following sections:

At low currents, first a non-self-sustaining dark discharge occurs. This section 37 is characterized by a positive current-voltage characteristic. In this section a plasma is not yet ignited. Thus, there is not yet a glow discharge. Ignition of a plasma occurs at the transition to section 38 which is known as sub-normal glow discharge. This section is characterized by a negative current-voltage characteristic and then transitions to section 39 of a normal glow discharge. In this section, the voltage remains essentially constant with increasing current. If current is to be increased further, this requires a significantly increasing voltage. This section 40 with a positive current-voltage characteristic is the section of abnormal glow discharge. Beyond a certain current threshold an arc discharge occurs which again has a negative current-voltage characteristic (section 41 in FIG. 3).

In section 39 of normal glow discharge as well as in section 38 of sub-normal glow discharge, the current is determined by filaments, with the spatial density thereof increasing with increasing current. In contrast, in section 40 of abnormal glow discharge the discharge spreads evenly over the entire electrode surface. Accordingly, in the example of FIG. 1B during an abnormal glow discharge the entire surface of electrode 22 will be covered by the glow discharge. So, the discharge is spatially homogenized to an optimum. The effect of the ions generated within the plasma of the glow discharge and acting on the lubricating film 20 and crosslinking the molecules thereof exhibits a corresponding spatial homogeneity.

However, if a glow discharge is performed in a different section of the current-voltage characteristic of glow discharge, the filaments cause a very inhomogeneous effect of the ions on the lubricating film and thus an inhomogeneous crosslinking. This in turn leads to local variations in surface properties, especially in the surface energy of the crosslinked film. Therefore, by taking advantage of the abnormal glow discharge a very homogeneous distribution of the surface energy and of the contact angles resulting therefrom can be achieved throughout the surface of the lubricating film. In this context it has been found that the conditions of an abnormal glow discharge with filament-free or at least filament-poor discharge can barely be realized with a treatment under atmospheric pressure. A plasma treatment under atmospheric conditions will therefore generally result in less homogeneous surface properties of the lubricating film.

Moreover, the low-pressure plasma treatment as proposed by the invention brings additional benefits. For example, the mass flow or consumption of process gas can be reduced significantly relative to a treatment at atmospheric pressure. In a treatment using low-pressure glow discharge, the gas consumption and the corresponding consumption costs for the process gas are usually lower by at least one or even two orders of magnitude relative to an atmospheric pressure plasma treatment. Another advantage of the low-pressure glow discharge is that, instead of noble gases, other process gases can be used to produce a homogeneous glow discharge, or the proportion of noble gas can be reduced. In contrast, in atmospheric pressure plasmas the use of noble gases is usually mandatory to allow for stable ignition of the plasma.

Furthermore, it was found that the decrease of surface energy induced by the low-pressure glow discharge can be influenced and in particular precisely adjusted through the power input per mole of the process gas, or in analogy thereto, per unit mass flow. The following correlations were found:

a) The surface energy of the silicon-free lubricating film can be modified relative to that of the untreated lubricating film surface by at least 3 mN/m, preferably by at least 5 mN/m, through an average power input <P> per unit mass flow F, <P>/F, of at least $5\times10^{-5}$ W/sccm during the surface treatment.

b) The surface energy of the silicon-free lubricating film can be reduced relative to that of the untreated lubricating film surface by at least 3 mN/m and by a maximum of 40 mN/m, preferably reduced by at least 5 mN/m and by a maximum of 38 mN/m, through an average power input per unit mass flow, <P>/F, in a range from $5\times10^{-5}$ W/sccm to $2\times10^{3}$ W/sccm, preferably in a range from $1\times10^{-3}$ W/sccm to $2\times10^{2}$ W/sccm during the surface treatment.

c) The surface energy of the silicon-free lubricating film can be reduced relative to that of the untreated lubricating film surface by at least 10 mN/m and by a maximum of 36 mN/m, preferably reduced by at least 20 mN/m and by a maximum of 35 mN/m, through an average power input per unit mass flow, <P>/F, in a range from $2\times10^{-1}$ W/sccm to $1\times10^{2}$ W/sccm, preferably in a range from $4\times10^{-1}$ W/sccm to $5\times10^{1}$ W/sccm during the surface treatment.

d) The polar component of the surface energy of the silicon-free lubricating film can be modified relative to that of the untreated lubricating film surface by at least 2 mN/m, preferably by at least 4 mN/m, through an average power input per unit mass flow, <P>/F, of at least $5\times10^{-5}$ W/sccm, preferably by at least $1\times10^{-3}$ W/sccm during the surface treatment.

e) The disperse component of the surface energy of the silicon-free lubricating film can be modified relative to that of the untreated lubricating film surface by at least 2 mN/m, preferably by at least 5 mN/m, through an average power input per unit mass flow, <P>/F, of at least $5\times10^{-5}$ W/sccm, preferably by at least $1\times10^{-3}$ W/sccm during the surface treatment.

f) By virtue of the low-pressure glow discharge, the polar component of the surface energy of the silicone-free lubricating film can be reduced by at least 5 mN/m and a maximum of 22 mN/m, preferably by at least 10 mN/m and a maximum of 21 mN/m, through an average power input per unit mass flow, <P>/F, in a range from $2\times10^{-1}$ W/sccm to $1\times10^{2}$ W/sccm, preferably in a range from $4\times10^{-1}$ W/sccm to $5\times10^{1}$ W/sccm during the surface treatment.

g) By virtue of the low-pressure glow discharge, the disperse component of the surface energy of the silicone-free lubricating film can be reduced by at least 5 mN/m and a maximum of 21 mN/m, preferably by at least 8 mN/m and a maximum of 20 mN/m, through an average power input per unit mass flow, <P>/F, in a range from $2\times10^{-1}$ W/sccm to $1\times10^{2}$ W/sccm, preferably through an average power input per unit mass flow, <P>/F, in a range from $4\times10^{-1}$ W/sccm to $5\times10^{1}$ W/sccm during the surface treatment.

h) By virtue of the low-pressure glow discharge, the contact angle of the silicone-free lubricating film for water can be modified by at least 2°, preferably by at least 5°, through an average power input per unit mass flow, <P>/F, of at least $5\times10^{-5}$ W/sccm, preferably at least $1\times10^{-3}$ W/sccm during the surface treatment.

i) By virtue of the low-pressure glow discharge, the contact angle of the silicone-free lubricating film for water can be increased by at least 10° and a maximum of 80°, preferably by at least 20° and a maximum of 70°, through an average power input per unit mass flow, <P>/F, in a range from $2\times10^{-1}$ W/sccm to $1\times10^{2}$ W/sccm, preferably through an average power input per unit mass flow, <P>/F, in a range from $4\times10^{-1}$ W/sccm to $5\times10^{1}$ W/sccm during the surface treatment.

j) By virtue of the low-pressure glow discharge, the contact angle of the silicone-free lubricating film for diiodomethane can be modified by at least 1°, preferably by at least 4°, through an average power input per unit mass flow, <P>/F, of at least $5\times10^{-5}$ W/sccm, preferably at least $1\times10^{-3}$ W/sccm during the surface treatment.

k) By virtue of the low-pressure glow discharge, the contact angle of the silicone-free lubricating film for diiodomethane can be increased by at least 5° and a maximum of 50°, preferably by at least 10° and a maximum of 40°, through an average power input per unit mass flow, <P>/F, in a range from $2\times10^{-1}$ W/sccm to $1\times10^{2}$ W/sccm, preferably through an average power input per unit mass flow, <P>/F, in a range from $4\times10^{-1}$ W/sccm to $5\times10^{1}$ W/sccm during the surface treatment.

l) By virtue of the low-pressure glow discharge, the contact angle of the silicone-free lubricating film for ethylene glycol can be modified by at least 1°, preferably by at least 3°, through an average power input per unit mass flow, <P>/F, of at least $5\times10^{-5}$ W/sccm, preferably at least $1\times10^{-3}$ W/sccm during the surface treatment.

m) By virtue of the low-pressure glow discharge, the contact angle of the silicone-free lubricating film for ethylene glycol can be increased by at least 5° and a maximum of 90°, preferably by at least 10° and a maximum of 70°, through an average power input per unit mass flow, <P>/F, in a range from $2\times10^{-1}$ W/sccm to $1\times10^{2}$ W/sccm, preferably through an average power input per unit mass flow, <P>/F, in a range from $4\times10^{-1}$ W/sccm to $5\times10^{1}$ W/sccm during the surface treatment.

n) By virtue of the low-pressure glow discharge, the contact angle of the silicone-free lubricating film for thiodiethanol can be modified by at least 2°, preferably by at least 5°, through an average power input per unit mass flow, <P>/F, of at least $5\times10^{-5}$ W/sccm, preferably at least $1\times10^{-3}$ W/sccm during the surface treatment.

o) By virtue of the low-pressure glow discharge, the contact angle of the silicone-free lubricating film for thiodiethanol can be increased by at least 10° and a maximum of 90°, preferably by at least 20° and a maximum of 80°, through an average power input per unit mass flow, <P>/F, in a range from $2\times10^{-1}$ W/sccm to $1\times10^{2}$ W/sccm, preferably through an average power input per unit mass flow, <P>/F, in a range from $4\times10^{-1}$ W/sccm to $5\times10^{1}$ W/sccm during the surface treatment.

An AC voltage suitable for introducing the average power for the low-pressure glow discharge has a frequency below 120 kHz, preferably in a range from 40 to 110 kHz, more preferably in a range from 60 to 100 kHz. An alternating current particularly suitable for the low-pressure glow discharge during the surface treatment has an mean current strength ranging from 0.1 mA to 500 mA, preferably in a range from 1 mA to 200 mA, more preferably in the range from 3 mA to 100 mA.

One explanation for the fact that with fluorine-containing organic molecules of the lubricating film the low-pressure glow discharge not only causes crosslinking but also a decrease of the surface energy which is very advantageous for the sliding properties is that by virtue of the energy input functional groups $CF_2$ or $CF_3$ are produced, or their amount at the lubricating film's surface is increased. Another factor is that the orientation of the molecular chains of the fluid compound relative to the substrate surface is modified.

For curing the silicone-free lubricating film 20, the voltage of AC voltage source 27 is preferably set such that within the plasma of the low pressure glow discharge electrons are generated with an energy spectrum of energies in a range between 1 eV and 20 eV, preferably in a range between 2.5 eV and 15 eV, more preferably in a range from 6 eV to 10 eV.

Additionally, by virtue of the low-pressure glow discharge the medical article is advantageously sterilized, or at least pre-sterilized. Sterility better than log 1, often even better than log 4 can be achieved. These levels can be achieved by an average power input per unit mass flow, <P>/F, of at least $5\times10^{-5}$ W/sccm, preferably at least $1\times10^{-3}$ W/sccm during the surface treatment. Most preferably, sterilization is obtained with a sterility better than log 5, by an average power input per unit mass flow, <P>/F, of at least $2\times10^{-2}$ W/sccm.

Yet another characteristic of crosslinking in a silicone-free organic lubricating film in a low-pressure plasma according to the invention is that crosslinking is very effective due to the spatial homogeneity of the energy input, and that under the low pressures used very few reaction products from the plasma are incorporated into the film. So, the contents of nitrogen oxides and ozone can be reduced to less than 1 ppm each. Also, due to the good crosslinking, in fluorine-containing lubricating films the proportion of volatile fluoro-organic compounds can be reduced to less than 10 ppm. In particular the concentration of ozone-depleting compounds with an ODP ("ozone depletion potential") level of greater than or equal to 0.005 is generally not more than 1 ppb.

Some exemplary embodiments of the method according to the invention are set forth below:

Exemplary Embodiment 1, Silicon-Free Lubricating Film on a Glass Syringe, Cured Using a Low-pressure Glow Discharge Glass syringe barrels of borosilicate glass (clear Fiolax), size 1.75 ml, are used as substrates. They are washed and dried. In a subsequent separate process step, the inner surface of the glass syringe barrel is spray-coated with a silicone-free oil of perfluoropolyether of the Fomblin M100 type, using a dual-material nozzle and the following spraying parameters: spray rate 0.75 μl/s, gas pressure for the spraying operation 0.5 bars, spraying duration 2 s.

During the spraying operation, the spray nozzle is moved along the syringe axis at an advance speed of 20 mm/s.

Then, the pre-coated glass syringe is placed in a low-pressure reaction chamber having an outer and an inner electrode, and is evacuated to a base pressure of less than 0.5 mbars. Then, argon gas is introduced into the reactor, or into the cavity of the syringe body, respectively, with a gas flow of 200 sccm, and process pressure is regulated to 10 mbars.

Using a medium-frequency source with a frequency of 100 kHz, a high voltage of 1 kV is applied to the electrode arrangement, and a homogeneous low-pressure glow discharge is ignited. The duration of treatment is 3 s.

The glass syringes coated with a lubricating film are equipped along with a silicone-free stopper of the Helvoet FM257 type, and measurements of static and kinetic friction are carried out before and after a storage test. The following data are obtained for the silicone-free lubricating film system of this example:

Breakaway force without storage: 9.6 N;

Breakaway force after 7 days of storage with distilled water at 40° C.: 13.4 N;

Mean sliding force without storage: 1.4 N;

Mean sliding force after 7 days of storage with distilled water at 40° C.: 1.9 N.

Exemplary Embodiment 1b) Tests For Long-term Stability of a Silicone-free Lubricating Film on a Glass Syringe, Cured Using a Low-pressure Glow Discharge Glass syringe barrels of borosilicate glass (clear Fiolax), size 1.75 ml, are used as substrates. They are washed and dried. In a subsequent separate process step, the inner surface of the glass syringe barrel is spray-coated with a silicone-free oil of perfluoropolyether of the Fomblin M100 type, using a dual-material nozzle and the following spraying parameters: spray rate 0.5 μl/s, gas pressure for the spraying operation 1.5 bars, spraying duration 1.4 s. During the spraying operation, the spray nozzle is moved along the syringe axis at an advance speed of 29 mm/s.

Then, the pre-coated glass syringe is placed in a low-pressure reaction chamber having an outer and an inner electrode, and is evacuated to a base pressure of less than 0.5 mbars. Then, argon gas is introduced into the reactor, or into the cavity of the syringe body, respectively, with a gas flow of 50 sccm, and the process pressure is regulated to 5 mbars.

Using a medium-frequency source with a frequency of 100 kHz, a high voltage of 7 kV is applied to the electrode arrangement, and a homogeneous low-pressure glow discharge is ignited. The duration of treatment is 5 s.

Figure 4:
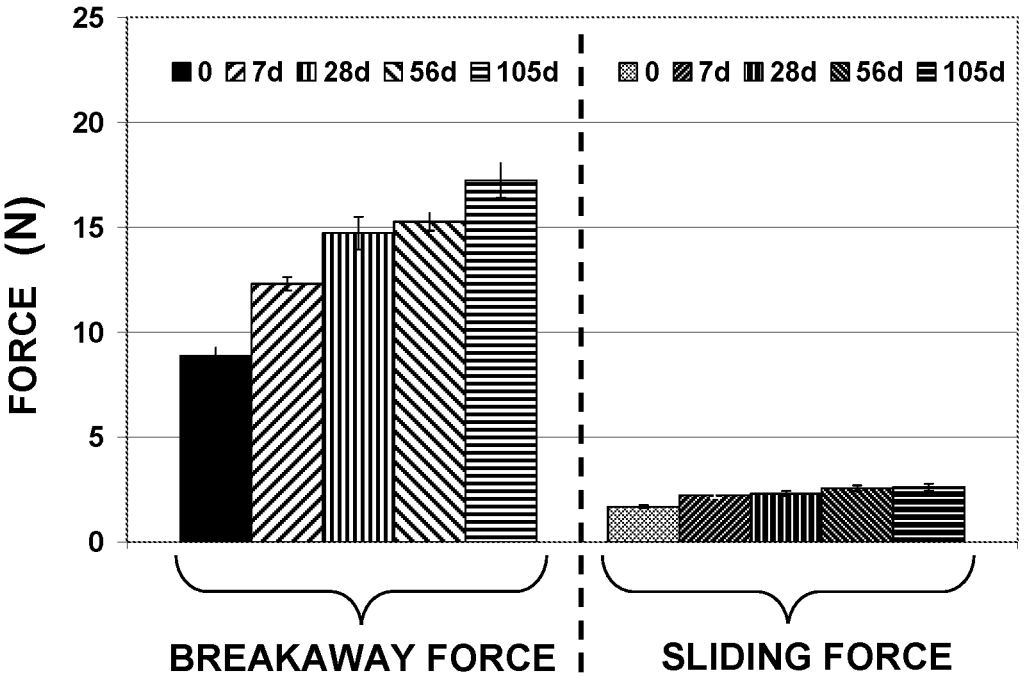
FIG. 4 shows breakaway force and mean sliding force of a silicone-free syringe system before and after storage at 40° C. with distilled water in function of storage time.

For this embodiment, FIG. 4 shows the breakaway force and the mean sliding force of a silicone-free syringe system before and after storage at 40° C. with distilled water, in function of storage time.

The glass syringes coated with a silicone-free lubricating film are equipped along with a silicone-free stopper of the Helvoet FM257 type to form a silicone-free syringe system. For a first part of the syringe systems, the static and average kinetic friction are determined before storage, which are marked as "0" in the legend of the diagram of FIG. 4. The second part of the syringes is filled with distilled water and then closed at the Luer cone by a tip cap and stored at a temperature of 40° C. for different time periods. After the respective storage period, the samples are cooled to room temperature, and measurements of static friction and average sliding friction are performed. The thus obtained values are illustrated in FIG. 4:

It turns out that the lubricating film of the silicone-free syringe system has a very good storage stability. Since, only a very small increase of the mean sliding force is observed over the entire storage period of up to 105 days: At the beginning of storage, the sliding force, after 7 days of storage, increases slightly from 1.7 N to 2.2 N. Between storage times of 7 days and 105 days, sliding friction then only increases from 2.2 N to 2.6 N. The breakaway force shows an increase typical for lubricating films during storage. First, the largest increase from 8.9 N to 12.3 N occurs within 7 days of storage, then the breakaway force increases to a value of 17.2 N after 105 days of storage. Thus, it has been shown that even after storage in an accelerated test at 40° C., the silicone-free syringe system still exhibits lubricant effects sufficiently good for the intended application.

Exemplary Embodiment 2: Silicone-Free Lubricating Film on Glass Syringe, Cured Using a Microwave-based Pulsed Low-Pressure Glow Discharge Similarly to example 1, a purified glass syringe body (1.75 ml) is spray-coated with Fomblin M100 oil using the following spraying parameters: spray rate 0.75 μl/s, gas pressure for the spraying operation 0.3 bars, spraying duration 2 s. During the spraying operation, the spray nozzle is moved along the syringe axis at an advance speed of 20 mm/s.

Then, the pre-coated glass syringe is placed in a low-pressure treatment reactor comprising a reaction chamber which can be evacuated and is connected to a vacuum pump and a process gas supply, and a microwave generator, a coaxial cable with an antenna. Initially, the syringe rests on the bottom of the reactor on a sealing surface. Then the top of the reactor is closed, and upon closing of the reactor the top of the syringe is sealed vacuum-tightly. The counter-pressure ensures that the syringe is also engaged vacuum-tightly at its lower end. Then, the interior of the syringe is evacuated until a base pressure below 0.05 mbars is obtained.

While at the lower end the connection to the vacuum is maintained, the gas inlet valve is opened, and argon process gas is introduced via the end having the narrow cross-section, i.e. the Luer cone of the syringe, with a flow of 50 sccm at a pressure of 0.25 mbars. Pulsed microwave energy of a frequency of 2.45 GHz is coupled into the interior of the reactor via the antenna, with an average pulse power of 39.2 watts, a pulse duration of 1 ms, and a pulse interval of 50 ms, through the waveguide into the reactor chamber, and the pre-coated inner surface of the syringe is treated with the pulsed microwaves over a period of 3 s. Once the lubricating film is cured, the reactor chamber is flooded to atmospheric pressure, and the coated syringe body is removed from the chamber.

The glass syringes coated with a lubricating film are equipped along with a silicone-free stopper of the Helvoet FM257 type, and measurements of static and kinetic friction are carried out before and after a storage test. The following data are obtained for the silicone-free lubricating film system of this example:

Breakaway force after 1 day of storage: 10.8 N;

Breakaway force after 7 days of storage with distilled water at 40° C.: 14.3 N;

Mean sliding force after 1 day of storage: 1.1 N;

Mean sliding force after 7 days of storage with distilled water at 40° C.: 1.2 N.

Exemplary Embodiment 3: Effect of the Treatment by Low-Pressure Glow Discharge on the Surface Energy and Wetting Behavior of the Lubricating Film Similarly to the methods of manufacturing described in examples 1 and 2, syringe glass bodies are spray-coated at the inner surface with Fomblin M100 oil and surface-treated and cured using method A) of a medium-frequency excited low-pressure glow discharge; or method B) of a pulsed microwave-excited low-pressure glow discharge.

As another reference, syringe glass bodies are only spray-coated with Fomblin M100 oil, but not cured. For characterization of the surface properties of the films, measurements of the contact angle are performed with liquids having different proportions of polar and disperse surface tension, whereby, additionally, the surface energy can be determined. Measurement data obtained from the samples are shown in the table below:

| sample type | surface treatment method | contact angle for water | ethylene glycol | diiodo-methane | thiodi-ethanol | surface energy (mN/m) polar | disperse | total |
|---|---|---|---|---|---|---|---|---|
| reference 1 | without | 43° | 30° | 73° | 30° | 22 | 21 | 43 |
| A | medium-frequency excited low-pressure glow discharge | 102° | 75° | 96° | 96° | 11 | 7 | 18 |
| B | microwave-excited low-pressure glow discharge | 108° | 96° | 102° | 102° | 2 | 8 | 10 |

The results in the table show that only by treating the fluid film by a low-pressure glow discharge, a low surface energy of the lubricating film is obtained. While the surface energy of the spray-deposited fluid film is relatively high, it is only lowered significantly by the energy input of the low-pressure glow discharge. The reduction of surface energy occurs both for the polar and the disperse component of the surface energy. In correlation thereto, the contact angle increases significantly, for water as well as for ethylene glycol, diiodomethane, and thiodiethanol.

Exemplary Embodiment 4: Silicone-Free Lubricating Film on Plastic Syringe

A plastic syringe body of COC (cyclic olefin copolymer), volume of 2.25 ml, is prepared similarly to example 2:

Fomblin M30 oil is spray-deposited on the inner surface of the syringe body using the following spraying parameters: spray rate 1.5 μl/s, gas pressure for the spraying operation 0.5 bars, spraying duration 2 s. During the spraying operation, the spray nozzle is moved along the syringe axis at an advance speed of 20 mm/s.

Subsequently, the pre-coated COC syringe is inserted into the same reactor as described in example 2. The interior of the syringe is evacuated until a base pressure of less than 0.05 mbars is reached. While at the lower end the connection to the vacuum is maintained, the gas inlet valve is opened, and argon process gas is introduced via the end with the narrow cross-section, i.e. the Luer cone of the syringe, with a flow of 50 sccm at a pressure of 0.25 mbars. Pulsed microwave energy of a frequency of 2.45 GHz is coupled into the interior of the reactor via the antenna, with an average pulse power of 39.2 watts, a pulse duration of 1 ms, and a pulse interval of 50 ms, through the waveguide into the reactor chamber, and the pre-coated inner surface of the syringe is treated with the pulsed microwaves over a period of 3 s. After curing of the lubricating film, the reactor chamber is flooded to atmospheric pressure, and the coated syringe body is removed from the chamber. The COC syringes coated with a lubricating film are equipped along with a silicone-free stopper of the Helvoet FM257 type, and measurements of static and kinetic friction are carried out before and after a storage test. The following data are obtained for the silicone-free lubricating film system of this example:

Breakaway force after 1 day of storage: 9.8 N;

Breakaway force after 7 days of storage with distilled water at 40° C.: 14.7 N;

Mean sliding force after 1 day of storage: 1.5 N;

Mean sliding force after 7 days of storage with distilled water at 40° C.: 1.9 N.

Further disclosed is a method for producing a lubricating film on a surface. In the method, on a surface of a hollow substrate for the lubricating film:

a silicone-free organic fluid is applied as a film;

the substrate is placed in a vacuum reactor; and the vacuum reactor is evacuated; and wherein an alternating electromagnetic field is generated by an AC voltage source and introduced into the interior of the substrate, a field strength thereof in the gas which is present in or introduced into the evacuated cavity of the substrate being sufficient to cause a homogeneous glow discharge under the pressure prevailing in the cavity of the substrate; wherein the pressure of the gas is set to less than 100 millibars, and wherein the lubricating film is subjected to the gas particles ionized during the glow discharge and accelerated in the alternating electromagnetic field and to the electrons generated during ionization, and wherein the gas particles by virtue of their energy input break the molecules of the film which as a result thereof crosslink with each other, so that a crosslinked lubricating film is produced, wherein with crosslinking the surface energy of the lubricating film is reduced.

In some embodiments of the method, the lubricating film is applied by means of a dual-material nozzle or a single-material atomizer, preferably by means of an ultrasonic atomizer, through spray-depositing onto the wall of the cavity.

In some embodiments of the method, an electrode is disposed in the cavity of the substrate, and an alternating electromagnetic field is generated by applying an AC voltage between said electrode in the cavity of the substrate and an outer electrode.

In some embodiments of the method, the electrode comprises a passage through which the cavity is evacuated and process gas is removed during the low-pressure glow discharge treatment.

In some embodiments of the method, a fluid quantity in a range from 0.004 $\mu l/cm^2$ to 2.8 $\mu l/cm^2$, preferably in a range from 0.009 $\mu l/cm^2$ to 0.22 $\mu l/cm^2$ is applied to the inner surface of the hollow body.

In some embodiments of the method, a low-pressure glow discharge is excited by a medium-frequency source with a frequency below 120 kHz, preferably in a range from 40 to 110 kHz, more preferably in a range from 60 to 100 kHz.

In some embodiments of the method, during the surface treatment, for the low-pressure glow discharge an alternating current is adjusted to an average current strength in a range from 0.1 mA to 500 mA, preferably in a range from 1 mA to 200 mA, more preferably in a range from 3 mA to 100 mA.

In some embodiments of the method, a silicone-free organic fluid is applied as said film, which fluid includes fluoroalkyl and/or ethylene groups, preferably a fluid with fluorinated or perfluorinated polyethers.

In some embodiments of the method, a silicone-free organic fluid is applied as said film, which fluid comprises the following molecular structure:

(i) R1-(O—CF—R—$CF_2$)$_p$—(O—$CF_2$)$_q$—R2; with p/q in a range from 0.1 to 1.0, and with R=—$CF_3$, or R=—F, (ii) functional groups R1, R2 selected from the group of: —$CF_3$, —F, —OH, —$C_xH_y$—OH, —$CH_2$—OH, $CH_2$ ($OCH_2CH_2$)$_r$OH, —$CH_2OCH_2CH$ (OH) $CH_2OH$, —$CH_2OCH_2$-piperonyl.

In some embodiments of the method, the pressure and the field strength of said alternating electromagnetic field are selected such that an abnormal glow discharge occurs in the cavity of the substrate which exhibits a current-voltage characteristic with positive slope.

In some embodiments of the method, a mass flow in a range from 1 sccm to 800 sccm, preferably in a range from 2 sccm to 500 sccm, more preferably from 5 sccm to 250 sccm is employed for the low-pressure glow discharge, whereby a homogeneous plasma zone is formed in the region of the cavity.

In some embodiments of the method, an average power <P> per unit mass flow F, <P>/F, of at least $5\times10^{-5}$ W/sccm is introduced for the low-pressure glow discharge, whereby the surface energy of the lubricating film is modified.

In some embodiments of the method, for the low-pressure glow discharge, an average power <P> per unit mass flow F, <P>/F, is introduced in a range from $5\times10^{-5}$ W/sccm to $2\times10^{3}$ W/sccm, preferably in a range from $1\times10^{-3}$ W/sccm to $2\times10^{2}$ W/sccm, whereby the surface energy of the lubricating film is reduced.

In some embodiments of the method, for the low-pressure glow discharge, an average power per unit mass flow <P>/F is introduced in a range from $2\times10^{-1}$ W/sccm to $1\times10^{2}$ W/sccm, preferably in a range from $4\times10^{-1}$ W/sccm to $5\times10^{1}$ W/sccm, whereby the surface energy of the surface of the lubricating film is reduced by at least 10 mN/m and a maximum of 36 mN/m, preferably by at least 20 mN/m and a maximum of 35 mN/m.

In some embodiments of the method, by virtue of the low-pressure glow discharge, both the polar and the disperse components of the surface energy are reduced simultaneously, which is associated with a liquid-repellent wetting behavior for liquids having different levels of the polar and disperse components of the surface energy.

What is claimed is:

1. A medical packaging comprising a cavity for receiving a pharmaceutical drug, wherein the cavity is coated with a silicone-free organic lubricating film, the silicone-free organic lubricating film having a uniformity of film thickness that is greater than or equal to 0.1, wherein the lubricating film comprises organic molecules homogeneously crosslinked via an abnormal glow discharge exhibiting a current/voltage characteristic with positive slope so as to provide a surface energy of not more than 60 mN/m that varies by less than ±20 mN/m or has a contact angle for water on the lubricating film that varies by less than ±25° and the lubricating film is produced from a material having a viscosity index of more than 80.

2. The medical packaging as claimed in claim 1, wherein the contact angle of the lubricating film for water is at least 60°.

3. The medical packaging as claimed in claim 1, wherein the lubricating film has the surface energy of not more than 40 mN/m.

4. The medical packaging as claimed in claim 1, wherein the lubricating film has the surface energy of not more than 30 mN/m.

5. The medical packaging as claimed in claim 1, wherein the contact angle of the lubricating film for water is in a range from 60° to 140°.

6. The medical packaging as claimed in claim 1, wherein the contact angle of the lubricating film for water is in a range from 65° to 130°.

7. The medical packaging as claimed in claim 1, wherein the contact angle of the lubricating film for water is in a range from 70° to 125°.

8. The medical packaging as claimed in claim 1, wherein the contact angle of the lubricating film for a) diiodomethane is in a range from 40° to 140°;

b) ethylene glycol is in a range from 20° to 100°;

c) thiodiethanol is in a range from 20° to 120°.

9. The medical packaging as claimed in claim 1, wherein the contact angle of the lubricating film for a) diiodomethane is in a range from 80° to 120°;

b) ethylene glycol is in a range from 35° to 110°;

c) thiodiethanol is in a range from 35° to 110°.

10. The medical packaging as claimed in claim 1, wherein the contact angle of the lubricating film for a) diiodomethane is in a range from 95° to 115°;

b) ethylene glycol is in a range from 60° to 105°;

c) thiodiethanol is in a range from 60° to 105°.

11. The medical packaging as claimed in claim 1, wherein the coated cavity comprises a cylinder for guiding a plunger.

12. The medical packaging as claimed in claim 1, wherein the surface energy of the lubricating film in the coated area varies by less than ±10 mN/m, or the contact angle for water on the lubricating film varies by less than ±15°.

13. The medical packaging as claimed in claim 1, further comprising two elements that slide on each other, wherein one of sliding surfaces of the elements is provided with the lubricating film having at least one of the following characteristics:

a. a dynamic sliding friction force measured at an advance rate of 100 millimeters per minute is less than 20 N, and a breakaway force is less than 30 N;

b. after storage of the packaging with distilled water or water for injection ("WFI") at 40° C. over a period of more than 100 days, the dynamic sliding friction force measured at an advance rate of 100 millimeters per minute is less than 20 N, and the breakaway force is less than 30 N;

c. the dynamic sliding friction force measured at an advance rate of 100 millimeters per minute is less than 10 N, and the breakaway force is less than 20N, wherein the two elements sliding on each other include a syringe or carpule cylinder and an elastomer, both of the sliding surfaces of the elements being provided with a fluoro-organic lubricating film.

14. The medical packaging as claimed in claim 1, further comprising two elements sliding on each other in form of a syringe or carpule cylinder and an elastomer, wherein sliding surfaces of the elements and also a substantial or entire surface portion of the contact surfaces of the elements to the cavity enclosed by the packaging are coated with a perfluorinated lubricating film.

15. The medical packaging as claimed in claim 1, wherein the surface energy is not more than 25 mN/m.

16. A medical packaging comprising:

a cavity for receiving a pharmaceutical drug, wherein the cavity is coated with a silicone-free organic lubricating film, the silicone-free organic lubricating film having a uniformity of film thickness that is greater than or equal to 0.1, wherein the lubricating film comprises organic molecules that are homogeneously crosslinked via an abnormal glow discharge exhibiting a current/voltage characteristic with positive slope to provide a surface energy of not more than 60 mN/m and the lubricating film is produced from a material having a viscosity index of more than 80, and the material comprises organic fluids with fluoroalkyl group;

a plunger in contact with a contact surface comprising the lubricating film; and a breakaway force between the lubricating film and the plunger that is less than 12 N, wherein the surface energy varies by less than ±20 mN/m or has a contact angle for water on the lubricating film that varies by less than ±25°.

17. The medical packaging as claimed in claim 16, wherein the plunger further comprises lubricating film thereon.

18. A medical packaging comprising:

a cavity coated with a lubricating film, wherein the lubricating film is silicone-free and comprises organic molecules that are homogeneously crosslinked via an abnormal glow discharge exhibiting a current/voltage characteristic with positive slope so as to provide a surface energy of not more than 60 mN/m that varies in the cavity by less than ±20 mN/m and the lubricating film is produced from a material having a viscosity index of more than 80, and the lubricating film comprises contents of nitrogen oxides and ozone that and ozone of less than 1 ppm from using a pulsing voltage, and the silicone-free organic lubricating film has a uniformity of film thickness that is greater than or equal to 0.1; and a plunger in the cavity and in contact with the lubricating film.

* * * * *